United States Patent [19]

Wang

[11] Patent Number: 4,606,538

[45] Date of Patent: Aug. 19, 1986

[54] PHYSICAL EXERCISE DEVICE

[76] Inventor: Kuo L. Wang, 456-1, Sec. 2, Chung Shan Rd., Tai Ping Hsiang, Tai Chung Hsien, Taiwan

[21] Appl. No.: 719,693

[22] Filed: Apr. 4, 1985

[51] Int. Cl.[4] ..... A63B 69/06; A63B 21/00

[52] U.S. Cl. ..... 272/72; 272/130; 272/134

[58] Field of Search ..... 272/72, 130, 134, 144, 272/145; D21/193-195

[56] References Cited

U.S. PATENT DOCUMENTS

| | | | |
|---|---|---|---|
| D. 226,439 | 3/1973 | Coker | 272/130 |
| 2,278,591 | 4/1942 | Sak | 272/72 |
| 4,284,272 | 8/1981 | Evans et al. | 272/72 |
| 4,336,934 | 6/1982 | Hanagan et al. | 272/72 |
| 4,357,010 | 11/1982 | Telle | 272/130 X |
| 4,397,462 | 8/1983 | Wilmarth | 272/130 |
| 4,463,945 | 8/1984 | Spector | 272/72 X |
| 4,465,274 | 8/1984 | Davenport | 272/130 |
| 4,477,071 | 10/1984 | Brown et al. | 272/130 X |
| 4,541,627 | 9/1985 | MacLean et al. | 272/72 |

FOREIGN PATENT DOCUMENTS

| | | | |
|---|---|---|---|
| 0150850 | 9/1981 | Fed. Rep. of Germany | 272/72 |

*Primary Examiner*—Robert A. Hafer
*Assistant Examiner*—Kathleen D'Arrigo
*Attorney, Agent, or Firm*—Knobbe, Martens, Olson & Bear

[57] ABSTRACT

The present application discloses a physical exercise device which comprises a base having a bracket at one end; a seat member detachably engaged with the base; a supporting frame having one end detachably engaged with the bracket; a handling means having a connecting plate, pivotally engaged to the other end of the supporting frame; and a hydraulic cylinder having one end pivotally connected to the supporting frame and the other end detachably connected to the connecting plate for producing hydraulic resistance.

10 Claims, 9 Drawing Figures

PHYSICAL EXERCISE DEVICE

BACKGROUND OF THE INVENTION

The present invention is related to an improved physical exercise device, and more particularly to an all-purpose physical exercise device which permits a user to perform various types of exercises, such as weight-lifting, expanding exercises, rowing exercises, etc.

One of the generally used physical exercise devices in training muscles is the weight-lifting apparatus which consists of a bar and two disc loading bar bells. Generally, such a weight-lifting apparatus is used by athletes in a gymnasium setting, and is not suitable for use in the home. Another physical exercise device is the rowing exercise apparatus which utilizes two handle bars connecting to two hydraulic cylinders to simulate the rowing action. Such a rowing exercise apparatus is also insufficient because it provides the user with only the single exercise option of rowing, resulting in the exercise and development of only part of the user's muscles. In addition, with repeated use, the user may feel uninterested in the dull rowing motion. Therefore, an all-purpose and compact physical exercise device for developing and strengthening muscles in the home which can provide a variety of exercise options for the user is long awaited.

SUMMARY OF THE INVENTION

It is the primary object of the present invention to provide an exercise device which is readily adjustable to permit the user to perform several different exercises with the same device.

It is also an object of the present invention to provide an exercise device which is of inexpensive but sturdy construction.

In accordance with one preferred embodiment of the present invention, a physical exercise device comprises a base having a bracket at one end; a seat member detachably engaged with the base; a supporting frame having one end detachably engaged with the bracket; a handling means having a connecting plate, pivotally engaged to the other end of the supporting frame; and a hydraulic cylinder having one end pivotally connected to the supporting frame and the other end detachably connected to the connecting plate for producing hydraulic resistance.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 1:
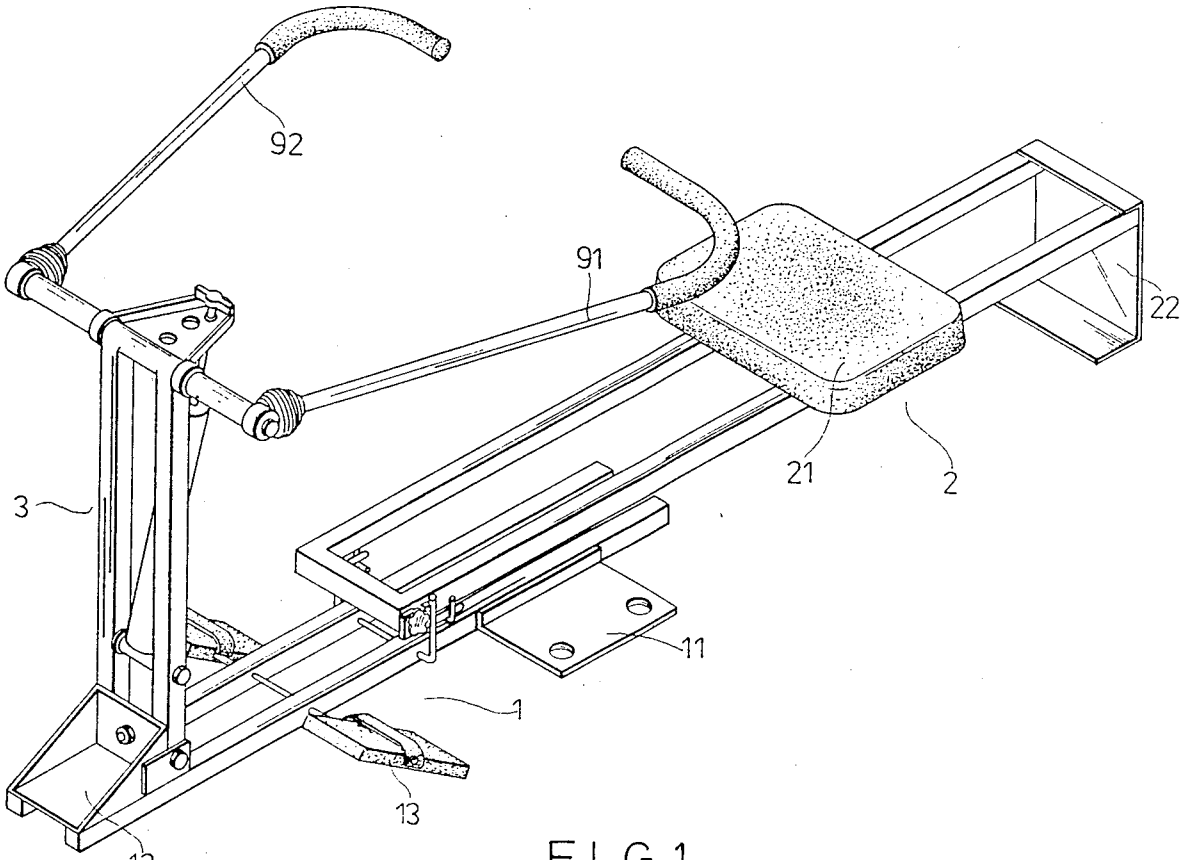
FIG. 1 is a perspective view of the physical exercise device in a first assembling situation according to one preferred embodiment of the present invention.
Figure 2:
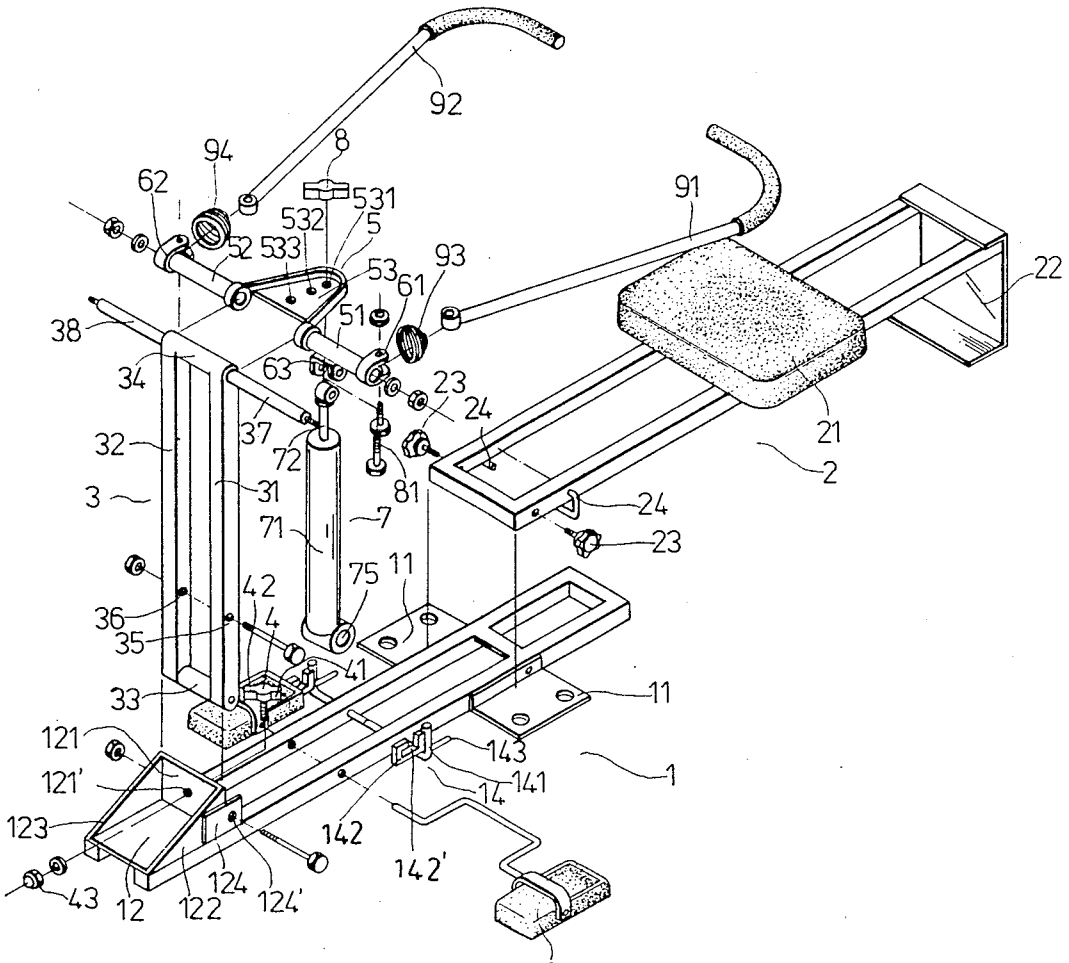
FIG. 2 is an exploded view of the physical exercise device of the present invention.

Referring now to the drawings, it should be noted that a like member is designated with a like reference number. In FIGS. 1 and 2, there is shown the physical exercise device according to one preferred embodiment of the present invention. A base 1 includes two supporting plates 11 secured to its two sides respectively at one end for supporting the base 1 firmly on the ground and for acting as two stationary pedals if necessary, and a bracket 12 substantially in triangular shape secured on the other end. The bracket 12 has two side plates 122 and 123 and a front plate 121 on which an aperture 121' is provided. Two reinforced plates 124 are respectively secured to the side plates 122 and 123 with a portion extending out from two sides of the front plate 121, each reinforced plate 124 has a first opening 124' thereon. A pair of pedals 13 are pivotally connected on the base 1 respectively and at the proper position between the supporting plates 11 and the bracket 12. An engaging set 14 is provided on the base 1 and at the adequate position between the supporting plates 11 and the pedals 13. The engaging set 14 comprises a U-shaped rod 141 disposed in the base 1 with its two vertical portions extending upwardly and outside the base 1, two retaining plates 142 respectively mounted on the vertical portions of the U-shaped rod 141 near its free end, and two retaining rods 143 respectively connected to the vertical portions of the U-shaped rod 141 on the opposite side to the retaining plate 142 with the other ends extending in the direction toward the supporting plates 11. Each retaining plate 142 has an L-shaped opening 142' thereon.

A seat member 2 has a seat 21 movably secured thereon for a user to sit down upon, a supporter 22 connected at its rear end for bearing a part of the weight of the user. Two first handled screws 23 are respectively provided on two sides of the seat member 2 near its front end, two L-shaped rods 24 are also provided on two sides of the seat member 2 and beside the first handled screws 23. The seat member 2 is detachably engaged with the base 1 as shown in FIG. 1, and this is achieved by the first handled screws 23 respectively located into the inner ends of the L-shaped openings 142' of the retaining plates 142, and then the first handled screws 23 are screwed on the retaining plates 142 in order to to fasten the seat member 2 on the base 1. In such condition, the lower part of the L-shaped rods 24 are located just under the retaining rods 143 respectively. By means of the retaining plates 142 and the retaining rods 143, the seat member 2 will not be forwardly or upwardly moved when the user is performing an exercise on the physical exercise device.

A supporting frame 3 substantially in a rectangular shape includes two long frames 31 and 32, two short frames 33 and 34, and a centrally hollow portion. The lowest short frame 33 is located between the reinforced plates 124, and is pivotally connected therebetween by a first screw screwing into a nut through the first openings 124' of the reinforced plates 124 and a first hole provided through the short frame 33. The lower portion of the supporting frame 3 is then engaged to the front plate 121 of the bracket 12 by a second handled screw 4 screwing into a nut 43 behind the front plate 121 through the centrally hollow portion of the supporting frame 3 and the aperture 121'. In this case, the handle of the second handled screw 4 is arranged in a horizontal position in order to abut against the long frames 31 and 32, so that the supporting frame 3 is firmly engaged with the front plate 121, and is held in an upright position. Two second openings 35 and 36 are respectively provided at the proper positions on the long frame 31 and 32. At the two ends of the upmost short frame 34, two rods 37 and 38 respectively extend therefrom in opposite directions.

A handling means 5 includes a connecting plate 53, two handle bars 91 and 92, two sleeves 51 and 52 sleeved on the rods 37 and 38 respectively, each sleeve 51 (or 52) being connected to the connecting plate 53 at one end and having a first ear element 61 (or 62) at the other end for pivotally connecting to the respective handle bar 91 (or 92), so that the handle bars 91 and 92 can be rotated in horizontal direction in relation to the first ear elements 61 and 62 of the sleeves 51 and 52, and two plastic resistors 93 and 94 respectively disposed on the connective portions between the handle bars 91 and 92 and the first ear elements 61 and 62 for resisting the movement of the handle bars 91 and 92. The connecting plate 53 is substantially in a triangular shape, and has three second holes 531 to 533 separately arranged with a predetermined distance thereon.

A hydraulic cylinder 7 includes a cylinder body 71 and a piston rod 72 mounted in the cylinder body 71 with a part extending out. One end of the cylinder body 71, through which a first orifice 75 is provided, is pivotally connected to the supporting frame 3 and between the long frames 31 and 32 by a second screw screwing into a nut through the the second openings 35 and 36 and the first orifice 75. A second ear element 63 is pivotally connected to one end of the piston rod 72, and a third screw 81 is screwed into a handled nut 8 through a second orifice on the second ear element 63 and one of the second holes 531–533 on the connecting plate 53, resulting in that the hydraulic cylinder 7 is pivotally connected to the connecting plate 53. It should be noted that the different second hole selected for connection will provide the user with a difference in resistance. In such a case, the hydraulic cylinder 7 inclines toward the seat member 2 as shown in FIG. 1.

Figure 3:
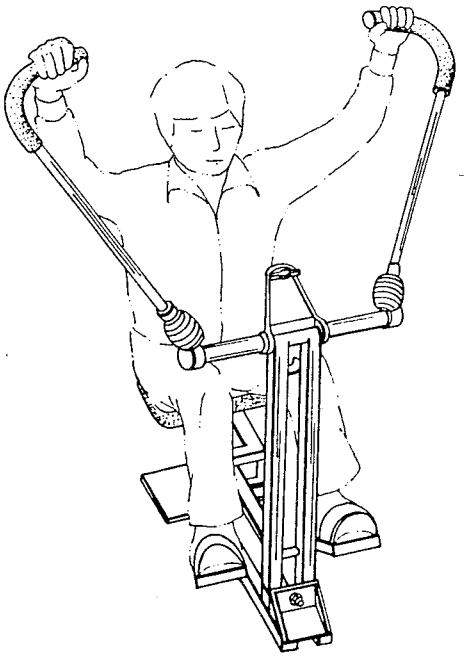
FIGS. 3, 4, and 5 are the schematic views of the physical exercise device of FIG. 1, illustrating that it is being used by a user performing various types of exercises.

According to the above-described structure of the physical exercise device, the user can make the handle bars 91 and 92 upwardly or downwardly rotate in relation to the rods 37 and 38, and leftwardly or rightwardly rotate in relation to the ear elements 61 and 62. Therefore, the physical exercise device of the present invention by merely utilizing one hydraulic cylinder, permits the user to perform several different exercises as follows:

(a) Referring to FIG. 3, the user sits on the seat 21 with his feet located on the pedals 13, holds the handle bars 91 and 92 with two hands in an ordinary grip, and then pushes the handle bars upwardly. Since the hydraulic cylinder 7 can provide the user with the hydraulic resistance, the pectoral muscles, the tergal muscles and the brachial muscles can be developed and strengthened.

Figure 4:
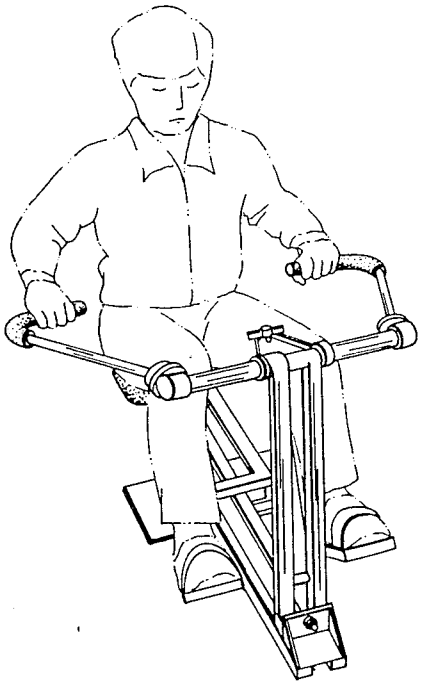

(b) Referring to FIG. 4, the user sits on the seat 21 with his feet located on the pedals 13 , holds the handle bars 91 and 92 with two hands in an ordinary or reverse grip, and then pulls the handle bars upwardly, whereby the wrist muscles, the brachial muscles and stomach muscles are developed and strengthened.

Figure 5:
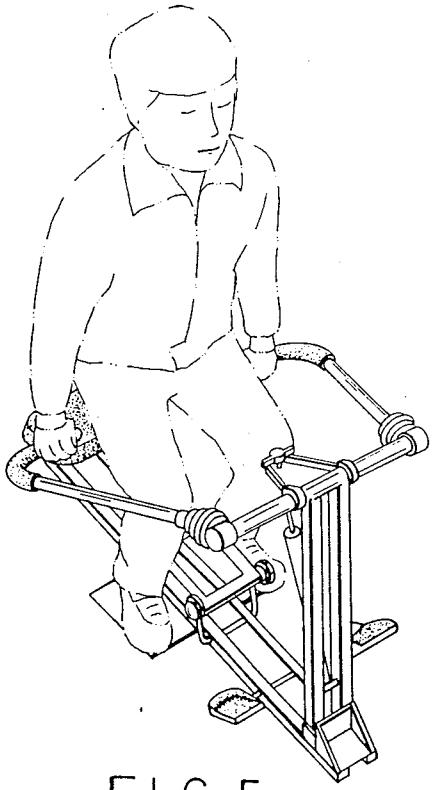

(c) Referring to FIG. 5, the user stands on the supporting plates 11, holds the handle bars with two hands, and then pulls the handle bars upwardly, whereby the leg muscles, the brachial muscles and the tergal muscles are developed and strengthened.

Figure 6:
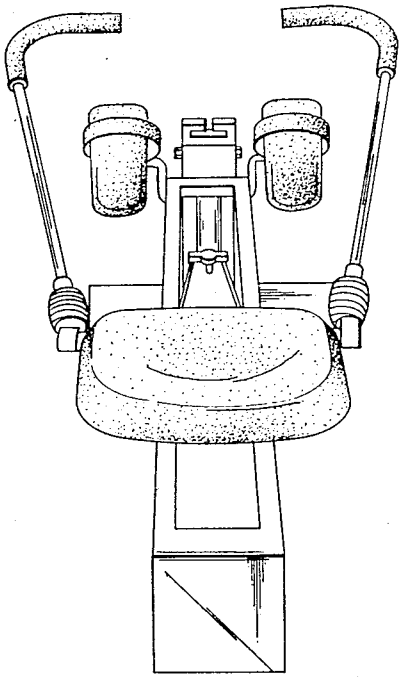
FIG. 6 is a perspective view of the physical exercise device in a second assembling situation according to one preferred embodiment of the present invention.

The above-described exercise device can be easily changed into a rowing exercise apparatus by the user. Referring to FIGS. 1, 2 and 6, first, the seat member 2 is removed from the base 1, the handled nut 8 unscrewed, causing the connecting plate 53 to separate from the hydraulic cylinder 7, the handling means 5 is rotated toward the side opposite to the seat member 2 in FIG. 1 or 2, and then the hydraulic cylinder 7 is connected to the connecting plate 53 again by way of the above-described method. The second handled screw 4 is unscrewed, and the supporting frame 3 with the hydraulic cylinder 7 and the handling means 5 are arranged to rest on the base 1. Finally, the seat member 2 is located above the supporting frame 3 and engaged with the base 1 according to the manner described above, and therefore the supporting frame 3 and the hydraulic cylinder 7 is retained between the base 1 and the seat member 2. In such a case, the handling means 5 can be moved to perform the rowing exercise and other types of exercises, and the hydraulic cylinder 7 inclines toward the bottom of the seat member 2.

Figure 7:
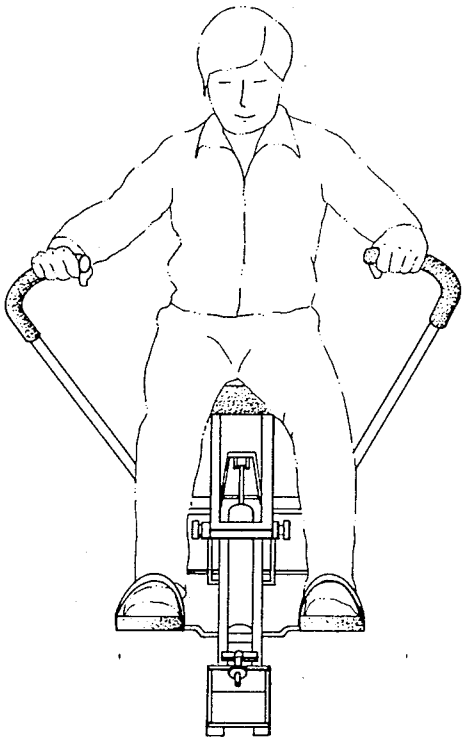

(d) Referring to FIG. 7, the user sits on the seat 21 with his feet located on the pedals 13, holds the handle bars with two hands, and then performs the rowing motion following the swing of his body.

Figure 8:
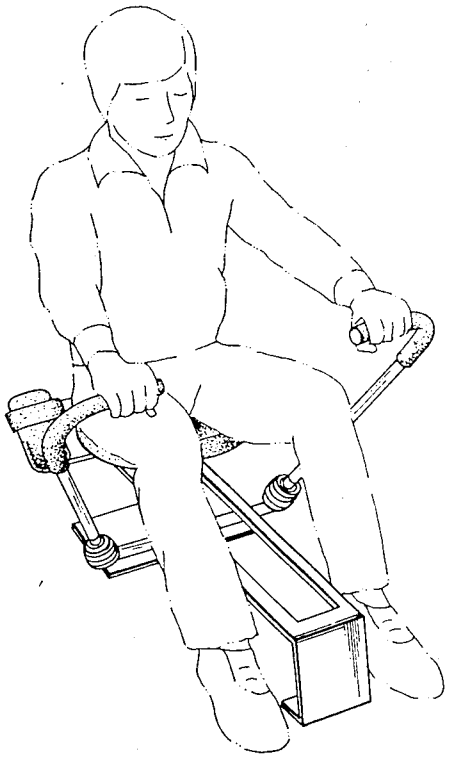
FIGS. 7, 8, and 9 are the schematic views of the physical exercise device of FIG. 6, illustrating that it is being used by a user performing various types of exercises.

(e) Referring to FIG. 8, the user sits on the seat 21 in the opposite direction, holds the handle bars, and then pushs the handle bars, whereby the brachial muscles are developed and strengthened.

Figure 9:
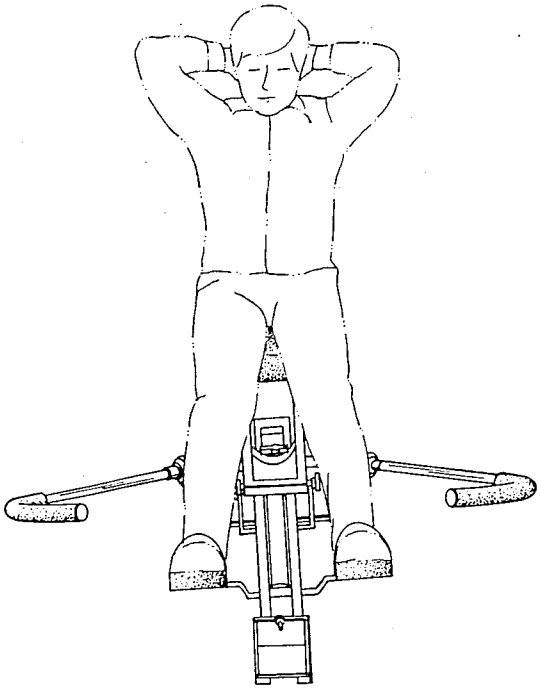

(f) Referring to FIG. 9, the user lays down on the seat member 2 with his feet fastened on the pedals 13 in order to perform sit-ups.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modification and equivalent structures.

What is claimed is:

1. A physical exercise device comprising:

a base having a bracket at one end;

a seat member detachably engaged with said base;

a supporting frame having two rods extending out therefrom in opposite directions and having one end detachably engaged with said bracket;

a handling means having a connecting plate, pivotally engaged to the other end of said supporting frame, two handle bars, two sleeves sleeved on said rods respectively, each sleeve being connected to said connecting plate at one end and having an ear element at the other end for pivotally connecting to said respective handle bar, so that said handle bars can be rotated in a horizontal direction, and two plastic resistors respectively sleeved on to the connective portions between said handle bars and said sleeves for resisting the movement of said handle bars; and a hydraulic cylinder comprised of a piston and a piston rod having the piston end connected to said supporting frame and the piston rod detachable connected to said connecting plate for producing hydraulic resistance.

2. A physical exercise device as claimed in claim 1, wherein said connecting plate has a plurality of holes for the piston rod of said hydraulic cylinder to selectively connect to said connecting plate through one hole in order to provide selective resistance.

3. A physical exercise device as claimed in claim 2, wherein said bracket has a front plate and two side plates, and said physical exercise device further comprises two reinforced plates respectively secured on said side plates of said bracket with a portion extending out from two sides of said front plate for said supporting frame to pivotally connect between said reinforced plates and adjacent to the front surface of said front plate, so that said supporting frame only can rotate between said base and said front surface when the engagement between said bracket and said supporting frame is detached.

4. A physical exercise device as claimed in claim 3, wherein said supporting frame is a rectangular frame which has a centrally hollow portion, with said hydraulic cylinder is mounted in said centrally hollow portion at its one end.

5. A physical exercise device as claimed in claim 4, wherein on said front plate of said bracket an aperture is provided, and said supporting frame is engaged to said front plate by a handled screw screwing into a nut behind said front plate through said centrally hollow portion of said supporting frame and said aperture with the handle of said handled screw abutting against said supporting frame, so that said supporting frame is firmly engaged with said base in an upright position, and so that said handle bars can be upwardly and downwardly moved in relation to said supporting frame.

6. A physical exercise device as claimed in claim 5, wherein said hydraulic cylinder inclines toward said seat member.

7. A physical exercise device as claimed in claim 6, wherein said physical exercise device further comprises a pair of pedals pivotally connected on said base respectively.

8. A physical exercise device as claimed in claim 4, wherein said supporting frame with said handling means are arranged between said base and said seat member, so that said handling means can be moved in rowing motion.

9. A physical exercise device as claimed in claim 8, wherein said hydraulic cylinder inclines toward the bottom of said seat member.

10. A physical exercise device as claimed in claim 9, wherein said physical exercise device further comprises a pair of pedals pivotally connected on said base respectively.

* * * * *